US011623817B2

(12) United States Patent
Loveall

(10) Patent No.: US 11,623,817 B2
(45) Date of Patent: Apr. 11, 2023

(54) FLOATING ROOM LEVELING AND PROTECTION APPARATUS

(71) Applicant: James H. Loveall, Beaumont, TX (US)

(72) Inventor: James H. Loveall, Beaumont, TX (US)

( * ) Notice: Subject to any disclaimer, the term of this patent is extended or adjusted under 35 U.S.C. 154(b) by 0 days.

(21) Appl. No.: 17/219,335

(22) Filed: Mar. 31, 2021

(65) Prior Publication Data

US 2022/0315323 A1 Oct. 6, 2022

(51) Int. Cl.
*B65D 88/40* (2006.01)
*B65D 88/36* (2006.01)

(52) U.S. Cl.
CPC ..... *B65D 88/40* (2013.01); *B65D 88/36* (2013.01)

(58) Field of Classification Search
CPC .... B65D 81/245; B65D 90/22; B65D 90/146; B65D 90/143; B65D 90/14; B65D 88/50; B65D 88/48; B65D 88/46; B65D 88/44; B65D 88/42; B65D 88/38; B65D 88/34; B65D 88/40; B65D 88/36
See application file for complete search history.

(56) References Cited

U.S. PATENT DOCUMENTS 2,847,755 A * 8/1958 Mummert ..... B65D 88/34 29/469
3,203,574 A 8/1965 Bodley
3,445,026 A 5/1969 Korn
4,070,044 A * 1/1978 Carrow ..... B29C 66/1122 285/285.1
5,353,941 A 10/1994 Benvegnu et al.
5,449,084 A * 9/1995 Wade ..... F16L 55/07 220/220
5,490,605 A * 2/1996 Cutts ..... B65D 88/34 220/220
5,628,421 A 5/1997 Jolly
8,863,974 B2 10/2014 Afeef
9,045,279 B2 * 6/2015 Eggemeyer ..... B65D 90/28
2012/0152950 A1 * 6/2012 Al-Subaiey ..... B65D 88/38 137/172
2017/0121103 A1 * 5/2017 Ellis ..... B65D 88/42

* cited by examiner

*Primary Examiner* — Kareen K Thomas
(74) *Attorney, Agent, or Firm* — Edward L. White; Edward L. White, PC

(57) ABSTRACT

A floating roof leveling and protection apparatus comprising a plurality of isolators having bases being formed of a protective material to prevent an internal metallic internal roof support leg from directly contacting a tank bottom, a body extending axially and centered therefrom, a tapered end for insertion into the roof support leg, a fluid passage, an engagement means engaging the inner perimeter of the roof support leg, and a drain and isolator spacers, whereby a user may place an isolator spacer on the isolator and insert isolators into the roof support legs of a floating roof system to adjust the height of the roof support legs to level the floating roof thereby reducing the stress placed on the floating roof as the fluid level lowers, thus preventing damage to the bottom of a tank when the fluid level is decreased and the roof support legs contact the tank's bottom.

8 Claims, 12 Drawing Sheets

FLOATING ROOM LEVELING AND PROTECTION APPARATUS

CROSS-REFERENCE TO RELATED APPLICATIONS

None.

FIELD OF THE INVENTION

The invention generally relates to an apparatus for protecting internal floating roofs by leveling support legs and lining and leveling a floating roof support that floats on top of the stored product within a storage tank. In particular, the invention relates to an apparatus for leveling the floating roof to reduce stress on the roof and protecting the roof support legs and bottom lining by inserting isolators with optional isolator spacers into the metallic internal roof support legs to obtain the desired height where the isolators engage the inner leg surface of the metallic roof support legs to removably maintain their position and the isolators engage the strike pad on the bottom of the tank to prevent damaging the lining/coating from repeated engagement caused by the raising and lowering of the fluid within the tank and corrosion caused therefrom.

BACKGROUND

Storage tanks are a vital piece of equipment in modern industrial life, particularly regarding hydrocarbon transportation, processing and use. In most storage environments, the fluid being stored can evaporate and be lost. Where the roof of the storage tank rests directly on the surface of the stored liquid, it minimizes loss of the stored liquid by evaporation. Two well-known types of storage tanks where a roof rests directly on the liquid are external floating roofs (EFRs) and internal floating roofs (IFRs). IFRs have a fixed roof above a floating roof, the fixed upper roof preventing rainfall from falling onto the floating roof. EFRs lack a fixed roof, and the floating roof is exposed to the elements.

For EFRs while they are sittings on the legs on the tank bottom during repair, maintenance, cleaning and inspections, if the EFR is not level it can become unstable during a heavy rain because of rain loading on a lower side. Uneven rain loads can add more stress on the roof, which can be transmitted to the tank bottom causing further settling and exacerbating pre-existing slope of the floor.

Floating roofs storage tanks are routinely provided with support legs. FIGS. 1-3 illustrate the general construction of a tank and of the floating roof within same. Floating roof tanks with support legs have been known for many decades. See, for example, U.S. Pat. No. 5,230,436 for a Liquid Storage Tank with Floating Roof Structure issued on Jul. 27, 1993, incorporated by reference.

During normal operation, with the roof floating up or down on the liquid stored in the tank, the pipe support legs are not in contact with the floor of the tank and are functionally inoperable. Under normally operation conditions, the legs may be maintained in a low position extending a lower distance from a lower surface of the lid to maximize the amount of movement of the lid allowed to accommodate the liquid level.

When the roof is not in floating normal operating position, for example when the roof is landed for repair or cleaning, the support legs are usually moved to a high leg position to provide more head room for persons working inside the tank under the floating roof.

To maintain the roof in a level position, the support legs need to be able to accommodate irregularities in the floor of the tank. Over the large surface area of storage tanks, there is rarely a perfectly level floor. Rather, the floor of such tanks is usually irregular. In prior art equipment, there was no easy way to level the support legs to accommodate irregularities in the floor. Failure to accommodate irregularities in the floor induced stress and strain on the roof risking damage to the roof, including the pontoons typically disposed around edges of the roof.

The support legs could be torch-trimmed (cut) on site, but that process is slow and expensive process and one that introduces unnecessary risk in a refinery or tank farm environment where flammable liquids and gases are often present. The trimming of support legs results in legs that have been shortened from their original engineered design. The act of cutting often causes corrosion of the remaining leg portion enhancing the risk of subsequent corrosion. Further, after the hydro testing between each service cycle, the floor often settles requiring further adjustment of the support legs involving another round of torch cutting.

Prior art equipment also provided no effective way to protect the tank bottom, including usual expensive coatings or linings, when the support legs set down on the tank bottom. The support legs thus usually penetrate the coating or lining exposing the metal tank to harsh chemicals (such as hydrogen sulfide and resulting sulfuric acid). When the coating or lining gets damaged by the support legs, it can let the noted harsh chemicals and water (which is heavier than hydrocarbons usually stored in floating roof tanks) between the coating or lining causing fast corrosion of the tank bottom and, over time, resulting in leaks and a tank bottom replacement.

SUMMARY OF THE INVENTION

The present invention includes a support leg leveling apparatus. The leg leveling apparatus includes an isolator affixed to the bottom of each support leg and includes several different sizes of leveling spacers that allow simple adjustment of support leg length. It also preferably protects the coating on the lower portion of the tank and cathodic protection for the tank as well as minimizing "cookie" buildup in the legs. The present invention protects the bottom of the support legs from damaging the coating or lining. The present invention allows the floating roof to always have a level, stress-free surface customized to accommodate irregularities in the tank floor.

There have thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out several purposes of the present invention. Additional benefits and advantages of the present invention will become apparent to those skilled in the art to which the present invention relates from the subsequent description of the preferred embodiment and the appended claims, taken in conjunction with the accompanying drawings. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

DETAILED DESCRIPTION OF THE INVENTION

Figure 1:
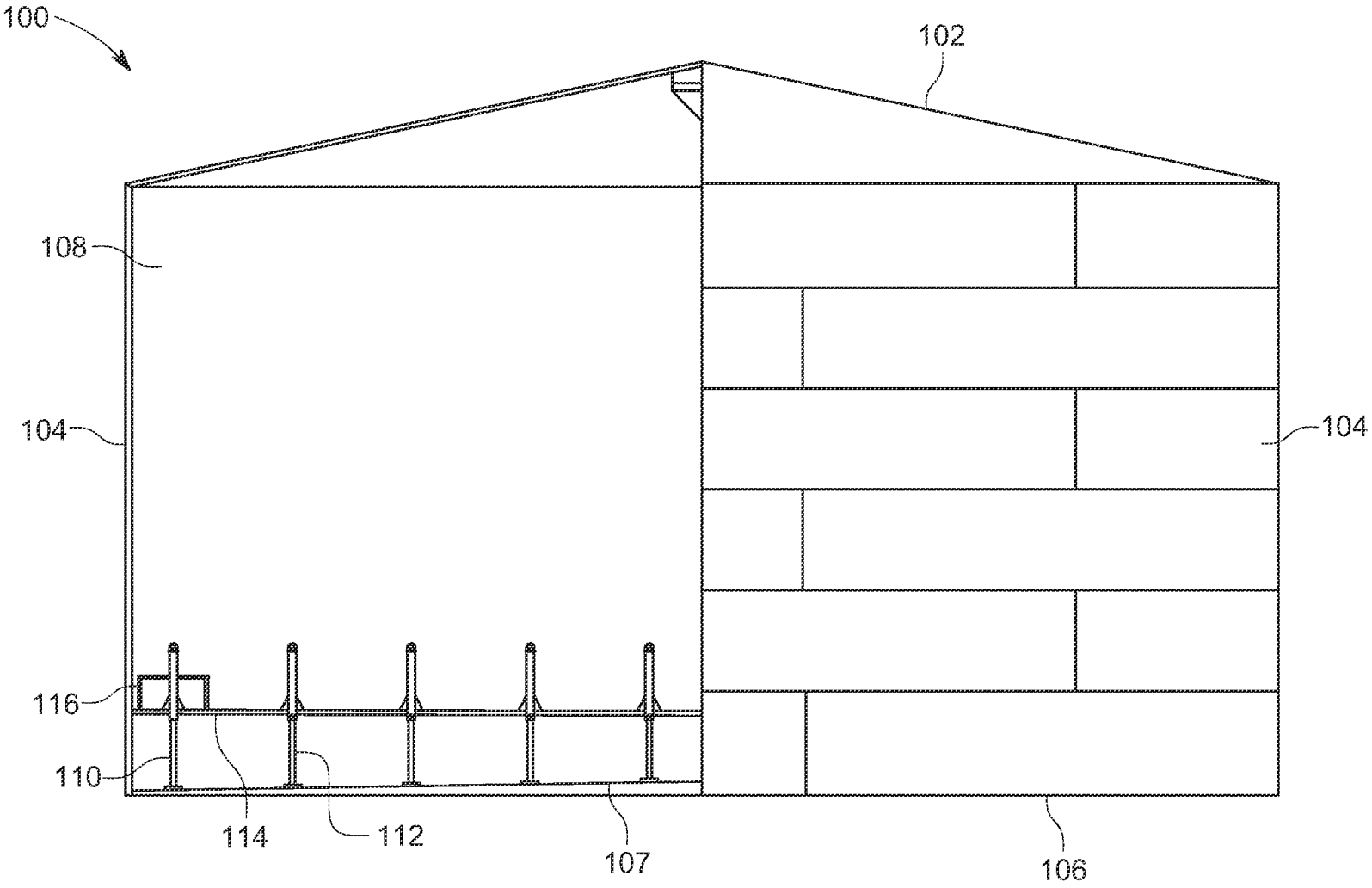
FIG. 1 is a partial cross-sectional side view of a tank 100.

FIG. 1 is a partial cross-sectional side view of a tank 100. The tank 100 has a fixed roof 102, which is optional for this type of tank. A shell 104 is provided to contain liquids (usually hydrocarbons) within the tank cavity 108. The tank 100 has a bottom plate 106. As shown, the bottom plate 106 has an unlevel surface 107.

A floating roof 114 is disposed within the cavity 108 and, in operation, rests on the surface of a liquid. A pontoon 116 is typically disposed around a periphery of the roof floating 114. The pontoon 116 serves multiple purposes including adding rigidity to a periphery of the floating roof 114, ensuring buoyancy, particularly if the roof should become loaded with rainwater (where a fixed roof is not present to shed rainfall). When not in operation (as shown), the floating roof 114 rests on a plurality of legs. Some of the legs penetrate the pontoon 116 and are thus called pontoon legs 110. Other legs penetrate the central floating roof deck and are called deck legs 112.

Figure 2:
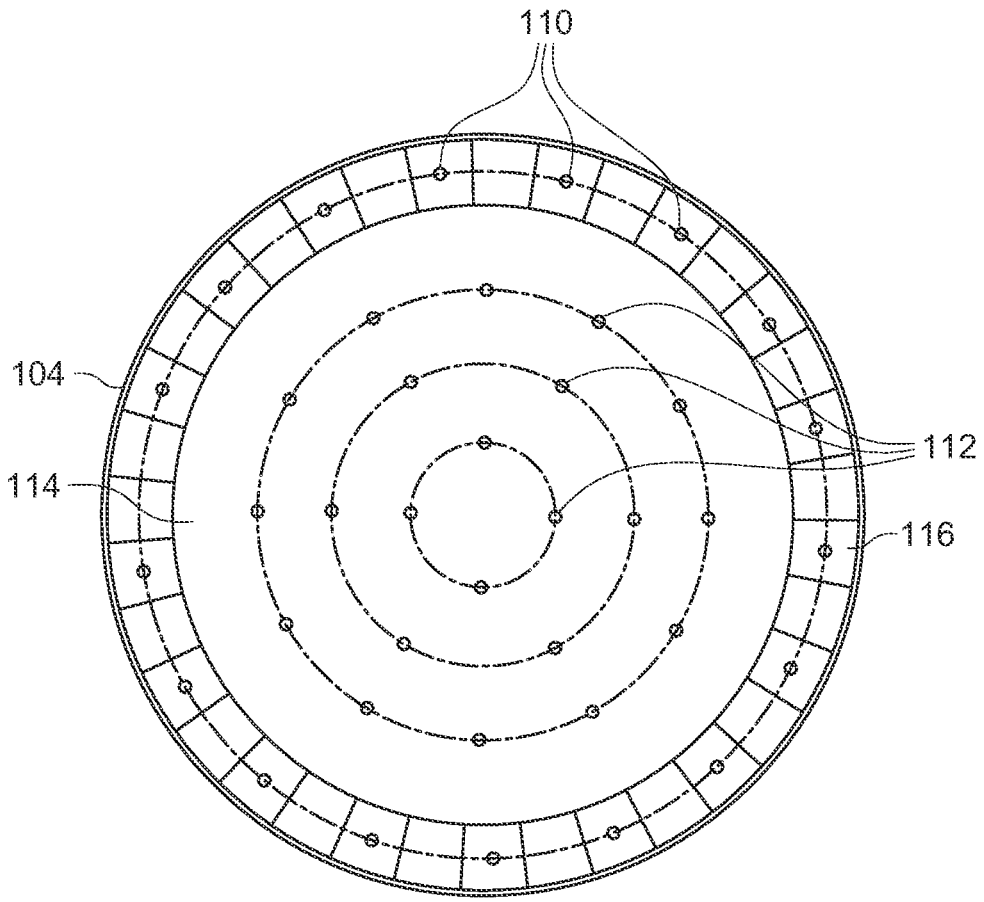
FIG. 2 is a top view of the floating roof 102.

FIG. 2 is a top view of the floating roof 114 showing the location of the pontoon legs 110 and deck legs 112. The pontoon 116 can be seen adjacent to the shell 104 around a periphery of the roof 114.

Figure 3:
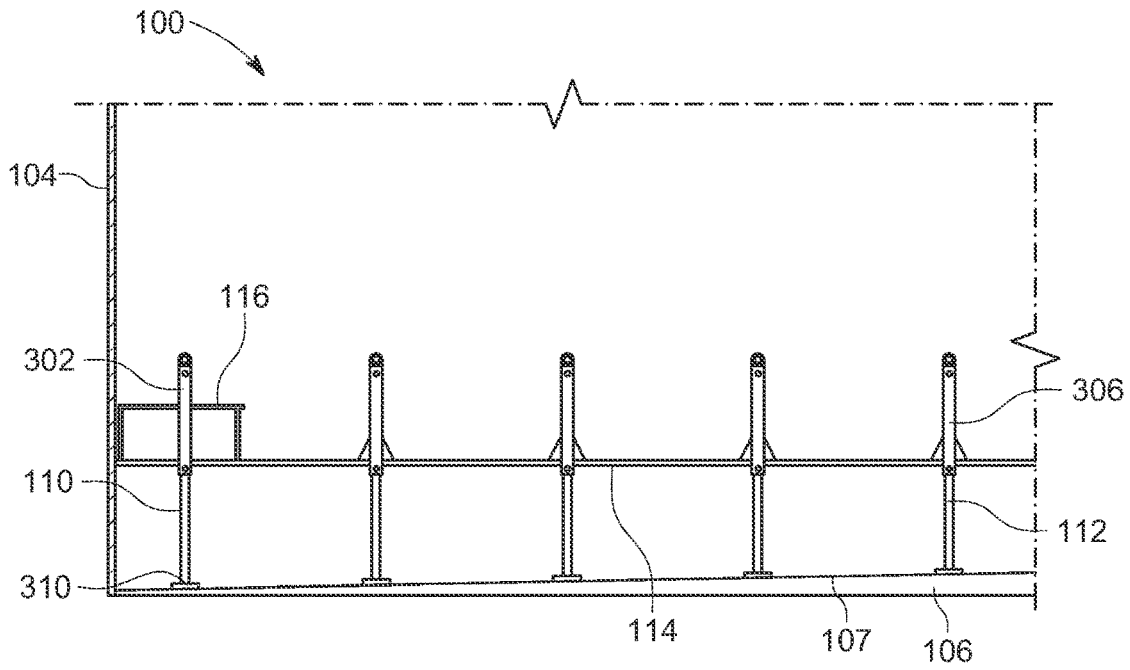
FIG. 3 is a cross-sectional view of the floating roof 114 resting on the tank bottom's unlevel surface 107.

FIG. 3 is a cross-sectional view of the floating roof 114. The pontoon 116 is seen adjacent to the shell 104. A pontoon leg receiver 302 extends through the pontoon 116 and receives therein a pontoon leg 110. Similarly, a deck leg receiver 306 extends through the floating roof 114 and receives therein a deck leg 112. Each of the receivers has at least two leg engagement means. See FIG. 4 for more detail. Preferably, the legs are held in place by a leg engagement means that is a penetration through the receiver receiving therein a stopper engaging the leg. Typically, the engagement means is a pin passing through corresponding holes in the receiver and the leg. It is preferable that the pin be affixed to the receiver by a chain or other similar device to ensure it is not lost upon removal from the receiver. The pin may further have a keyhole on a terminal end to retain it in the receiver by receiving therein a key such as a Cotter key or a Cotter pin or the like. Those skilled in the art will perceive a large number of other means for preventing a member received in a larger member from sliding with respect to one another such as a threaded member penetrating both or a threaded member in frictional engagement with the inner member.

At the bottom of each leg is a striker pad 310. The striker pad 310 is preferably affixed to the tank bottom 106. The striker pad 310 provides a sacrificial surface upon which each leg rests. To the extent the leg may scratch a coating on the striker pad 310, it acts as a sacrificial member preventing the bottom 106 from being eroded by friction or action of harsh chemicals.

It is preferable that the bottom 106 and the shell 104 be protected by a coating up to at least a foot above the bottom 106. The coating helps protect the metal of the shell 104 and bottom 106 from action of harsh chemicals often present in hydrocarbon storage tanks. Hydrocarbons frequently contain hydrogen sulfide. Hydrogen sulfide is corrosive to metal on its own account. Further, any water present in the tank (whether produced water entering the tank with the hydrocarbons or rainwater entering the tank) typically settles on the bottom 106 since water is typically denser than hydrocarbons. The interaction of water and hydrogen sulfide can produce extremely corrosive sulfuric acid. Sludge with higher concentrations of harsh chemicals typically builds up on the bottom 104. Sludge can reach depths of a foot or more. The coating helps prevent corrosion of the bottom 106 and shell 104 from the sludge, harsh chemicals and water.

Figure 4:
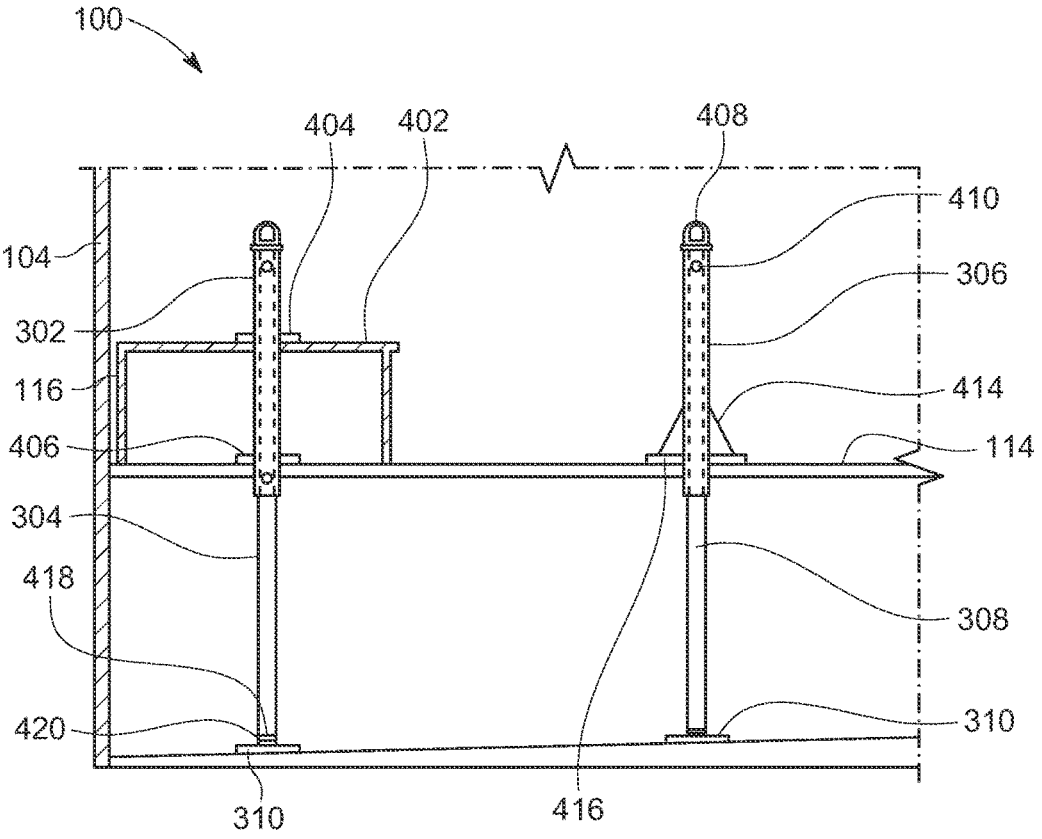
FIG. 4 is a closer cross-sectional view of the tank 100 and floating roof 114 resting on the tank bottom's unlevel surface 107.

FIG. 4 is a closer cross-sectional view of the tank 100 and floating roof 114. For the pontoon 116, the pontoon top plate 402 can be seen disposed above the floating roof 114. The pontoon leg receiver 302 can be seen penetrating the pontoon 116. The penetrations are preferably reinforced with a pontoon top reinforcer 404 and a bottom reinforcer 406. The deck leg receiver 306 penetrates the floating roof 114 and reinforced with a deck reinforcer 416 and a stability rib 414.

As previously discussed, in operation, the floating roof 114 floats on the surface of a stored liquid. To maximize the flexibility of the tank to allow for fluctuation in the stored volume, the legs are preferably positioned closer to the floating roof 114 than the legs would be when the tank is out of service. Therefore, a pin hole 410 is provided for engagement with more than one corresponding hole in a leg allowing selection of different leg positions for operational versus non-operational status. The operational status preferably provides enough space between the bottom 106 and the roof 114 to accommodate sludge buildup. If the roof 114 ever could directly rest on the sludge buildup, there is a risk that the roof would become so solidly affixed to the bottom 106 that it could not be raised again.

When switching between operational and non-operational modes, the roof 114 may be lifted by air, water or oil. To lift the roof 114, each leg preferably includes a leg hook eye 408. The roof may be pinned on high leg to let the tank be drained of product and then cleaned for inspection and repair purposes. During repair, or if a leg is to be removed for cleaning or repair, it will be a jacking device and a small mechanical lifting device to pull the leg.

Figure 5:
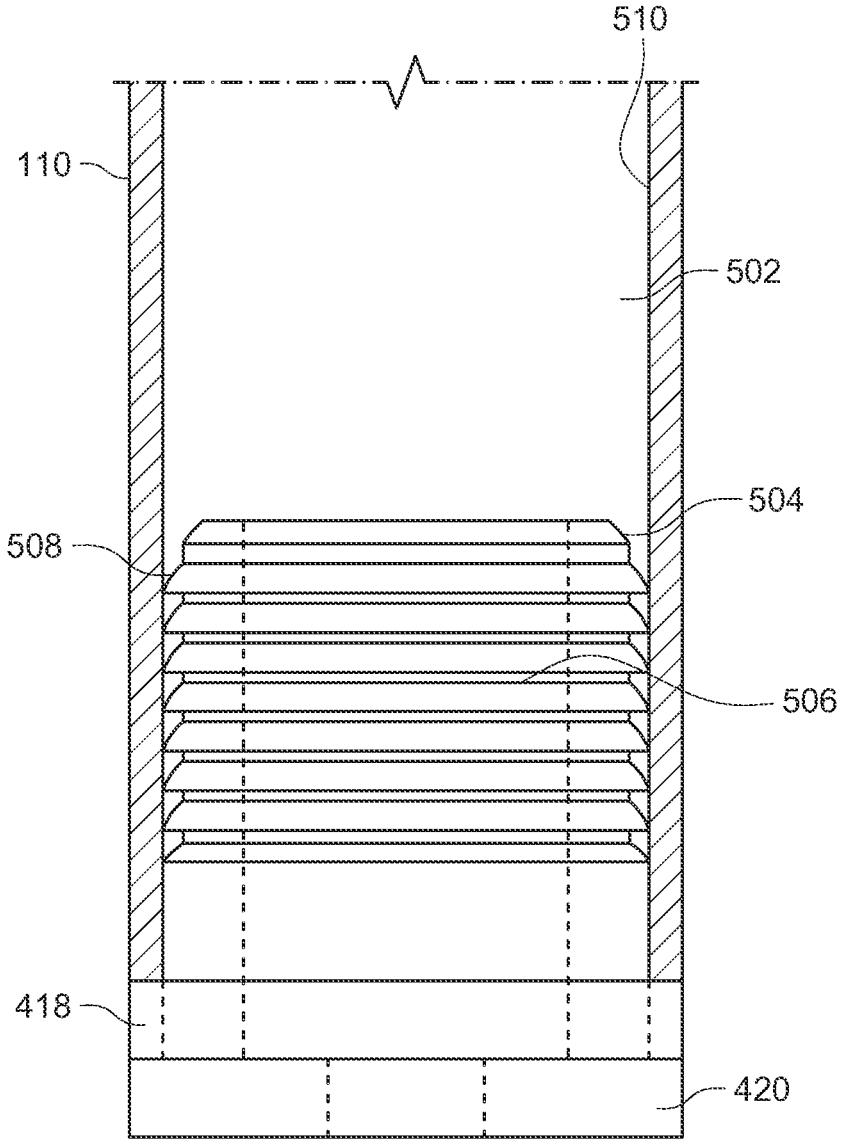
FIG. 5 is a partial cross-sectional view of a leg 110 or 112 with an isolator 500 (not in cross section) inserted.

At the bottom of each support leg 110, a base of the isolator 500 rests on the striker pad 310. The base creates separation between the support leg 110 and the striker pad 310. The base hereinafter referred to as a foot 420. Shown above the foot 420 is an optional spacer 416. As shown in FIG. 4, the foot 420 in cooperation with the spacer 416 increases the over height of a support leg 110. FIG. 5 below, shows additional detail for these features.

FIG. 5 is a partial cross-sectional view of a leg 110 or 112 with an isolator 500 (not in cross section) inserted. Each leg typically defines therein a leg cavity 502. The embodiment shown in FIG. 5 comprises an isolator 500 with a body having a cross section sized and shaped to be received in the leg cavity 502. Legs are typically circular, so both the leg and the isolator 500 typically have circular cross sections. However, the legs could be square tubing, rectangular tubing or any other shape that may be desired. Whatever the shape of the leg, the isolator is adapted to engage the inner leg surface 510 and, in the embodiment shown in FIG. 5, to be received within the leg cavity 502.

The isolator 500 includes a body 506 preferably having a tapered upper end 504 to facilitate insertion and a foot 420 mounted at the other end. Defined through the isolator 500 is a continuous fluid passage shown with dashed lines. An upper portion of the body 506 defines a plurality of fins 508 thereon. As the isolator 500 is inserted, the fins 508 are deformed slightly in pressing engagement with an inner surface of the leg cavity 502. The 508 thus resist removal of the isolator 500. This pressing engagement retains the isolator 500 in place. Such ribs are used in a wide variety of applications and made from a variety of materials. Applicant incorporates by reference U.S. Pat. No. 4,810,144 for a Tube Connector issued Mar. 7, 1989 (teaching metallic ribs); U.S. Pat. No. 5,308,205 for a Plastic Retaining Peg, For Furniture Fittings issued May 3, 1994.

A spacer 418 is shown having been slidingly inserted onto the body 506. Preferably, a range of spacer sizes is provided allowing a user to more easily accommodate irregularities in the bottom 106 such as the unlevel surface 107 shown in FIG. 1. More than one spacer can provide additional accommodation for variations, and different size spacers can be combined to accommodate irregularities.

Figure 6:
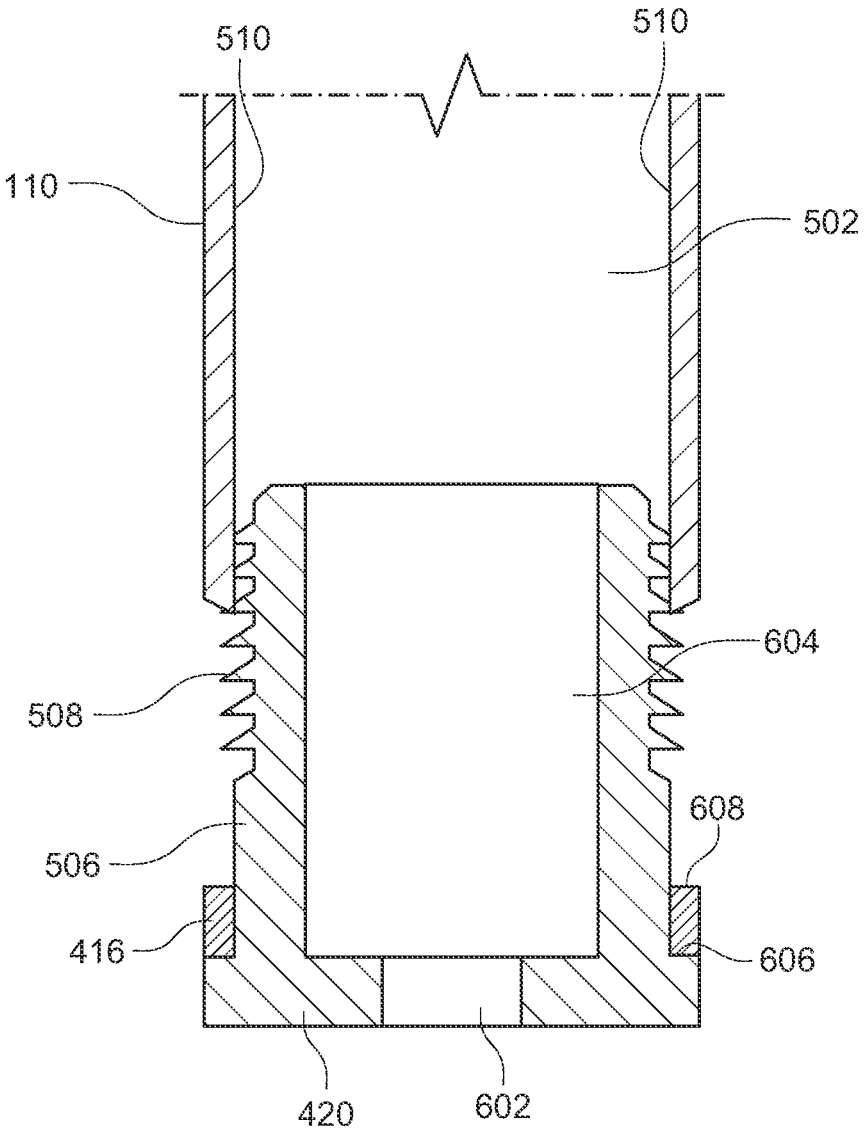
FIG. 6 is a cross-sectional view of both a leg 110 or 112 with an isolator 500 partially inserted and a spacer 416 installed on the isolator 500.

FIG. 6 is a cross-sectional view of a leg 110 or 112 with an isolator 500 partially inserted and a spacer 416 installed on the isolator 500. The lower surface 606 of the spacer 416 engages the foot 420, and the upper surface 608 of the spacer 416 engages and supports the leg 110. In cross section, the passage 602 through the foot 420 can be more clearly seen as can the communicating passage 604 through the body 506.

Figure 7:
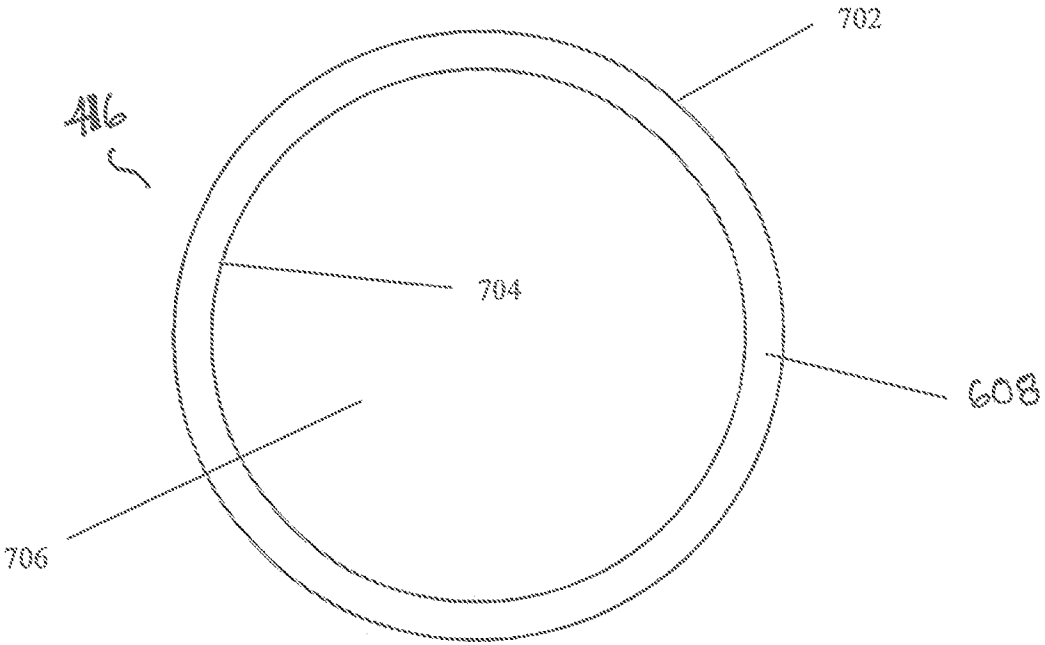
FIG. 7 is a top view of a spacer 416.
Figure 8:
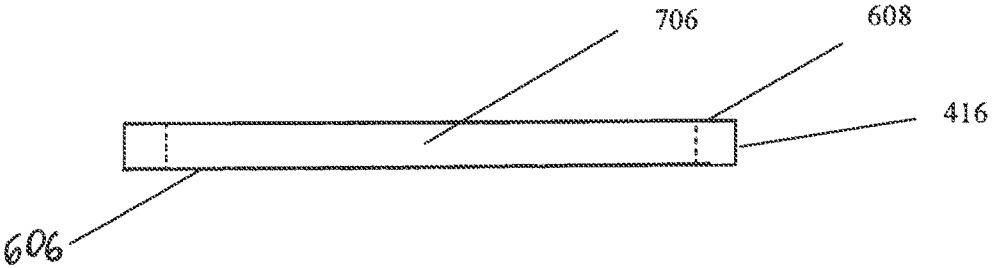
FIG. 8 is a side view of a spacer 416.

FIG. 7 is a top view of a spacer 416 illustrating that it is a simple ring. The upper surface 608 can be seen as the outer circumference 702 and inner circumference 704. The inner circumference 704 is preferably sized and shaped to snugly engage the body 506, and the inner circumference defines a washer hole 706 therethrough. The outer circumference 702 is preferably sized and shaped to be at least as large as the leg so that the upper surface 608 engages substantially all the bottom of the leg to support it. Similarly, FIG. 8 is a side view of a spacer 416. The lower and upper surfaces 606 and 608 can be seen.

Figure 9:
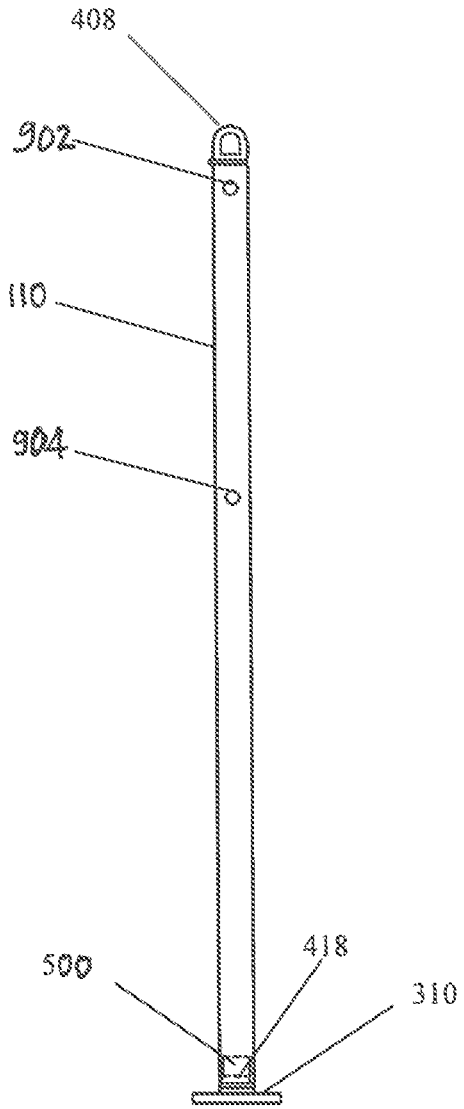
FIG. 9 is a side view of a leg 110 or 112 with an isolator 500 installed and resting on a striker pad 310.

FIG. 9 is a side view of a leg 110 or 112 with an isolator 500 installed and resting on a striker pad 310. The leg eye hook 408 is at the top of the leg 110. At its lower end, the leg 110 engages an isolator 500 with a cooperating spacer 418 visible. The spacer 418 rests on a striker pad 310. A first pin hole 902 is shown adjacent to the eye hook 408, and a second pin hole 904 is shown closer to the middle of the leg. If a pin passes through the leg pin hole 410 and through the first pin hole 902, the leg is held in a position preferred for nonoperation of a storage tank (for example for maintenance or repair). The bottom of the leg is pushed down farther from the floating roof 114, providing enough space for workers to enter the tank under the floating roof 114. If a pin passes through the leg pin hole 410 and through the second pin hole 904, it is placed in a low leg operating position, preferably ensuring just enough clearance between the floating roof 114 and the bottom 106 to accommodate the most usage of the tank in getting the oil to the lowest level without damaging the floating roof or the internal piping.

Figure 10:
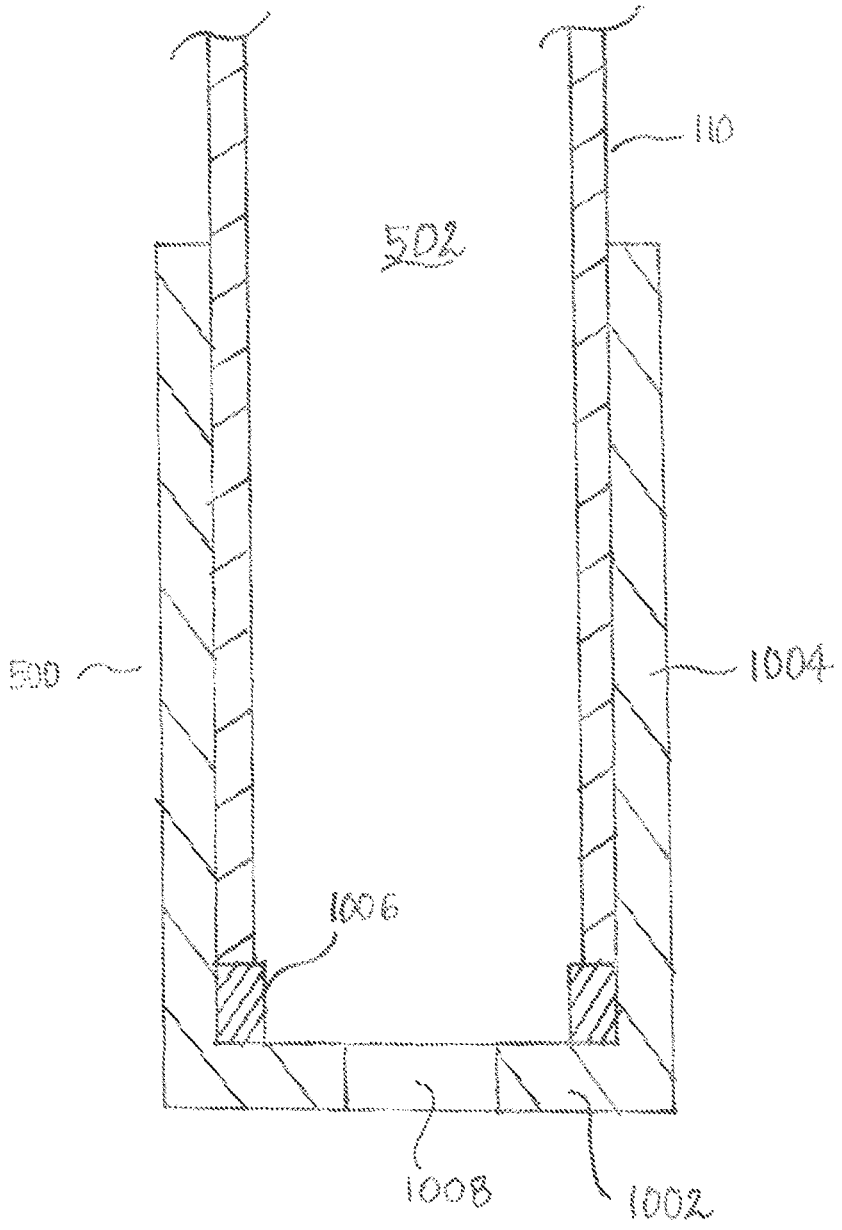
FIG. 10 is a cross sectional side view of a second embodiment with an external sleeve 1004.

FIG. 10 is a cross-sectional side view of an alternative embodiment of the isolator 500. In this embodiment, the isolator 500 comprises a foot 1002 from which a sleeve 1004 extends up engaging an outer surface of the legs 110 or 112. The foot defines therein a passage 1008. The sleeve body 1004 grippingly engages an outer surface of the leg 110. The spacer 1006 is sized and shaped to slidingly be received within the sleeve body 1004. As with the previously described embodiment, the spacer 1006 preferably is provided in multiple thicknesses to make it easier to accommodate variations in the bottom 106. A passage is defined in the foot 1002 allowing fluid 1008 communication between the tank and the leg cavity 502.

Figure 11:
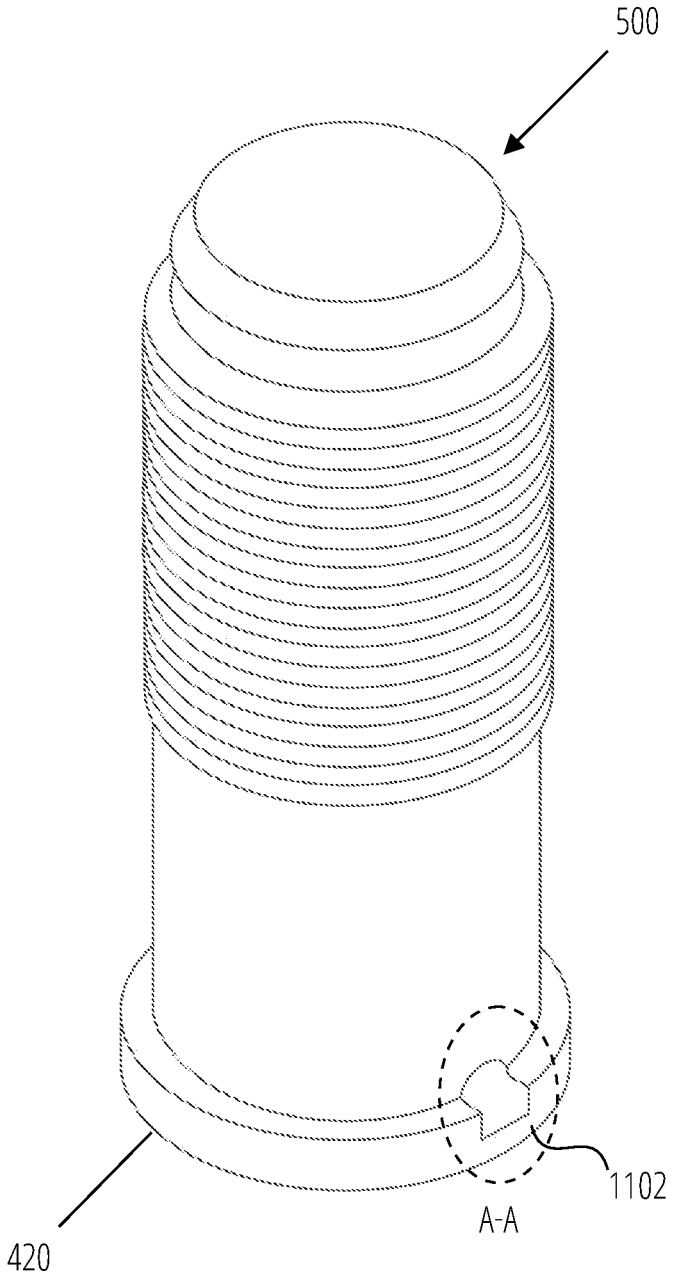
FIG. 11 is a perspective view of an embodiment of the isolator.

FIG. 11 is a perspective view of an embodiment of the isolator 500 featuring a passage 1102. The passage 1102 extends horizontally from one end of the diameter of the foot 420 to the opposite end. The passage 1102 is a channel for fluid to flow therethrough and as a slot for removing the isolator 500 for maintenance or repair. When fluid is compressed over a period of time it transforms from a liquid into a compressed solid. The compressed solid creates a harmful sludge that is costly to remove. Fluid flow is necessary to reduce sludge build up. The present invention satisfies the need to reduce sludge build up.

Figure 12:
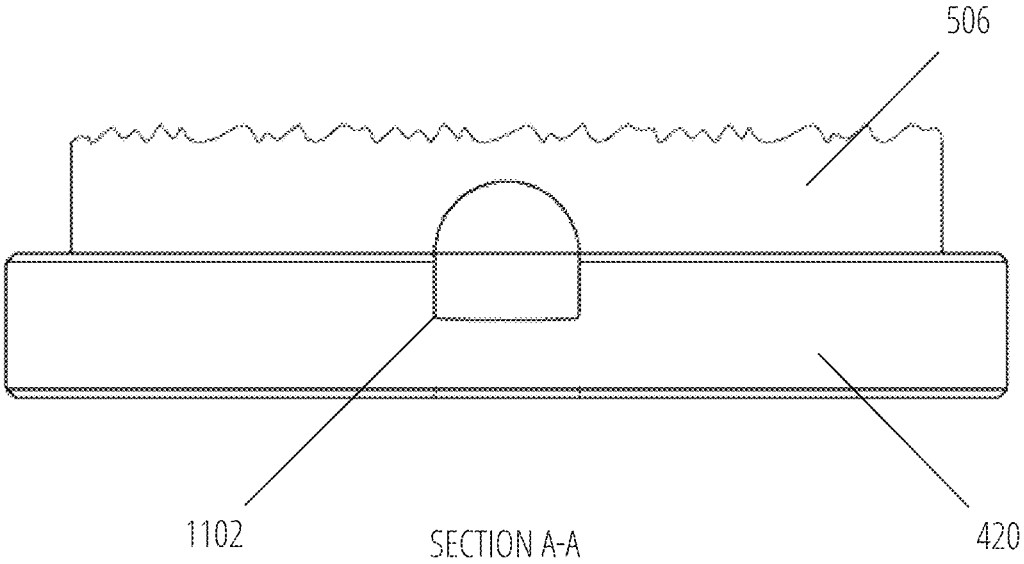
FIG. 12 is a detail view of section A-A of an embodiment of the isolator.

FIG. 12 is a detail view of section A-A of the passage 1102. The passage 1102 extends horizontally through the foot 420 and through the body 506. The passage 1102 is substantially circular but can be truncated at any end to create a rounded plan boundary or a polygonal shape.

Figure 13:
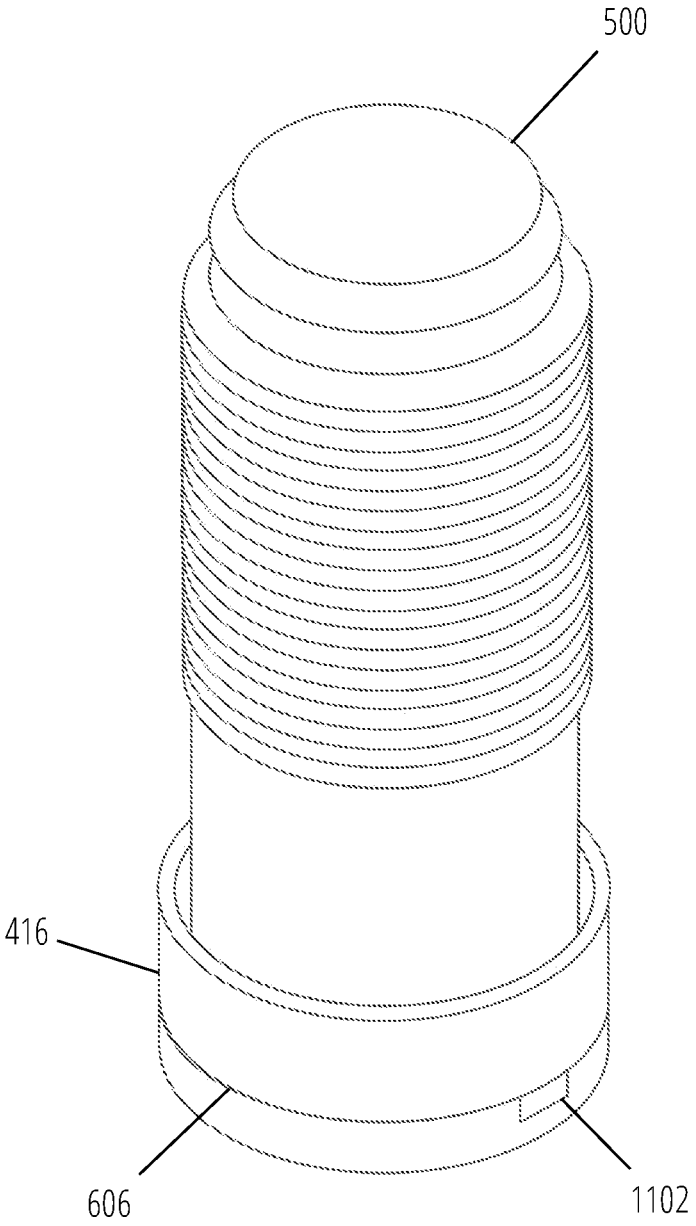
FIG. 13 is a perspective view of an isolator in cooperation with a spacer.

FIG. 13 is a perspective view of an isolator 500 in cooperation with a spacer 416. The lower surface 606 of the spacer 416 engages the isolator 500. As shown in FIG. 13 the spacer does not completely cover the passage 1102. There is some clearance between the spacer 416 and the foot 420 for fluid to flow therethrough. Additional spacers 416 of varying thicknesses can be stacked on top of each other. Once an isolator 500 in cooperation with at least one spacer 416 is inserted into a roof support leg 110 (not pictured, see FIG. 4-6), the isolator 500 is not flush with the bottom surface of the leg 110. Thus, the overall height of the support leg 110 is adjusted by the isolator 500 in cooperation with at least one spacer 416. The desired height adjustment can be achieved by stacking the necessary number of spacers 416. During maintenance and repair if it is desired that the overall height of a support leg is reduced, the appropriate number of spacers 416 can be removed without the need of cutting or welding. Once all legs have been adjusted with the appropriate number of spacers 416, a proper level internal floating roof can be achieved. The present invention satisfies the need of simple leveling system that does not require cutting.

Figure 14:
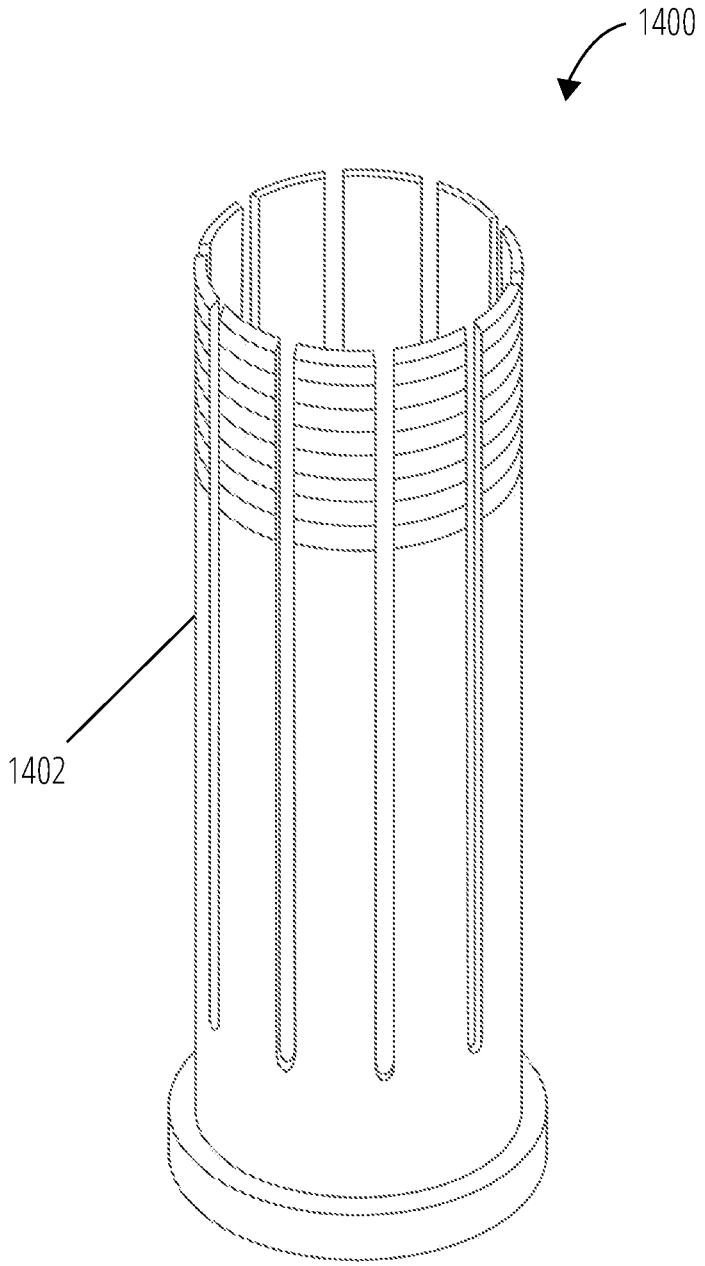
FIG. 14 is a perspective view of collet-style embodiment of an isolator.

FIG. 14 is a perspective view of a collet-style isolator 1400. The collet-style isolator 1400 features a collet-style body 1402. The collet-style body 1402 can, be squeezed against a matching taper of a support leg 110 (not pictured) such that its inner surface of the collet-style body 1402 contracts to a slightly smaller diameter.

Having thus described the invention, I claim:

1. A leveling and protection apparatus for an internal floating roof including a plurality of support legs supporting the roof at a minimum height above a floor of a tank, the apparatus comprising:

a. an isolator comprising:

a base engaging the floor of the tank, the base comprising of a protective material and defining a first passage therethrough;

a body, the body extending upwardly from the base and defining a second passage therethrough in communication with the first passage; and b. a spacer engaging the isolator:

whereby, each support leg is fitted with an isolator.

2. The apparatus of claim 1 further comprising:

a. the base comprising a base plate having an area larger than an outer area of each support leg thus defining a ledge under the support leg the base formed of a protective material and defining a first passage therethrough;

b. the body comprising a projection extending upwardly from the base and having an area smaller than an inner area of the support leg and a profile and shape sized for insertion into the bottom of the support leg, the body defining a second passage therethrough in communication with the first passage; and c. the spacer comprising at least one spacer, each spacer comprising:

i) an opening defined therethrough greater than area of body and sized to be slid onto the body to engage the base, and ii) an outer area greater than the outer area of the support legs;

whereby a desired length of each support leg is determined, and an isolator is inserted into it with a desired height of spacers is installed thereon and engaged into each support leg to adjust the height of the support leg as needed to provide level, stress-free support for the roof.

3. The apparatus of claim 1 further comprising:

a. the base comprising a base plate, the base formed of a protective material and defining a first passage therethrough;

b. the body comprising a projection extending upwardly from the base and having an area larger than an outer area of the support leg and a profile and shape sized for engulfing the bottom of the support leg, the body defining a second passage therethrough in communication with the first passage;

c. the height adjustment means comprising at least one spacer, each spacer comprising:

a) an outer area smaller than an inner area of the body and a sized, b) shape to slide into the body to engage the base, and c) an opening defined therein not greater than the inner area of the support leg;

whereby a desired length of each support leg is determined, and an isolator is inserted onto it with a desired height of spacers is installed therein and engaged into each support leg to adjust the height of the support leg as needed to provide level, stress-free support for the roof.

4. The apparatus of claim 1, where the protective material is selected from a group of a synthetic polymer, a natural polymer, wood, and cork.

5. The apparatus of claim 2, where a portion of the body is tapered for slidable engaging the inner diameter of the support leg.

6. The apparatus of claim 2, where spacers are provided with a range of thicknesses.

7. The apparatus of claim 2, where the spacer is split to allow for placement on the isolator without removing it from the support leg.

8. The apparatus of claim 1, where the body further comprising an engagement means that is selected from a group consisting of ribs, threads, teeth, and magnets.

* * * * *